United States Patent [19]

Brabec

[11] 4,287,826

[45] Sep. 8, 1981

[54] METHOD AND APPARATUS FOR SCREEN PRINTING

[76] Inventor: Michael W. Brabec, 6135 N. 5th Pl., Phoenix, Ariz. 85012

[21] Appl. No.: 25,672

[22] Filed: Mar. 30, 1979

[51] Int. Cl.[3] ..... B41F 15/04; B05C 17/06

[52] U.S. Cl. ..... 101/115; 101/123; 101/126

[58] Field of Search ..... 101/126, 123, 115, 48, 101/114; 198/427, 472

[56] References Cited

U.S. PATENT DOCUMENTS

| | | | |
|---|---|---|---|
| 2,846,946 | 8/1958 | Schwarzberger | 101/115 |
| 3,795,189 | 3/1974 | Jaffa | 101/123 |
| 3,848,528 | 11/1974 | Seedorf | 101/115 |

*Primary Examiner*—Edgar S. Burr
*Assistant Examiner*—A. Heinz
*Attorney, Agent, or Firm*—Gregory J. Nelson

[57] ABSTRACT

This disclosure is directed to an in-line, multi-station screen printer which has a first track for receiving a plurality of platen carriers. A series of printing heads are disposed above the first track and adapted to register with the carriers at pre-selected locations. Means are associated with each of the platens to hold the workpiece in a taut position on the platen. A drying station is located at the end of the printing stations and includes a silicone rubber heater which can be brought into direct contact or close proximity with the platen surface to dry the screening ink or dye. Once the drying cycle is completed, the carriers are discharged on a second, return track to be returned to the loading and unloading end of the machine where the operator can unload the carrier and replace the completed workpiece with a new workpiece.

6 Claims, 11 Drawing Figures

METHOD AND APPARATUS FOR SCREEN PRINTING

The present invention relates to a method and apparatus for printing or more particularly relates to a method and apparatus for multiple station printing and utilizing screening techniques for applying designs to textiles, fabrics, paper and the like.

The application of designs to textiles, paper and other materials by screening methods is well-known. Generally this technique involves use of a printing head having a stretched silk screen or wire mesh screen mounted in a frame carrying a pattern determined by an emulsion coating on part of the mesh or screen. The article to be screened is brought into contact or close proximity with one surface of the screen and an appropriate ink or dye is placed on the opposite side of the screen. A squeegee is drawn back and forth over the screen forcing the dye or ink through portions of the screen devoid of emulsion. The ink is transferred to the subjacent material and the pattern imparted to the material. In multicolored printing processes, it is necessary to transfer the material from one printing station to another where additional colors and designs may be applied. The article printed is then usually dried in some type of hot-air, ultra violet or infra red dryer.

Various apparatus can be found in the prior art for increasing productivity of screening processes by use of automated or semi-automated equipment. Most of these involve the use of a rotary table which moves platens on which the article to be printed is mounted from station to station. A different color is applied at each station either by manual operation of a squeegee or by an automatically operated squeegee. Normally the fabric or material is removed from the platen when the printing process is complete and inserted in a dryer of some type. Typical of these machines are the type of machine designated as the model MPP-48 four-color rotary screen printer, manufactured by Precision Screen Machines, Inc. of Hawthorne, N.J., and the machine designated the Automatic Cameo Multi-Printer, manufactured by American Screen Printing Equipment Co., Chicago, Ill.

Though these machines are effective and represent an advance over the state of the art, certain shortcomings are apparent with machines of this type. The rotary multi-color printer has inherent practical limitations as to size. The number of stations which may be utilized is limited as inclusion of substantial number of stations would make the diameter of the machine, as a practical matter, excessive. Further, the rotary machine requires substantial space in a shop or working area. Rotary devices generally do not provide for the inclusion of a dryer section so that it is necessary to remove the garment, article or fabric from the screening or printing machine and place the article in a dryer, a separate step which increases process time and decreases the over-all efficiency of the screening process.

Briefly, in accordance with the present invention, an in-line screen printer and dryer is provided including a frame supporting an upper horizontal track and a lower horizontal return track. Loading, printing and drying stations are provided along the frame. The articles to be printed are mounted on a carrier having adjustable platen for maintaining the article in a taut condition. The carriers can be advanced along the upper horizontal track and indexing means position the carriers at pre-selected locations to register with printing heads in the printing station. A drying station is located at the end of the printing stations and includes a silicone rubber heating element which is brought into contact with the article on the platen. Upon the completion of the drying operation, the carrier is transferred to the lower return track by a pivotal transfer mechanism so that the carrier is returned to the loading station.

The above objects and advantages of the present invention will become more apparent from the following specification, claims and drawings in which:

Figures 1, 2, 5:
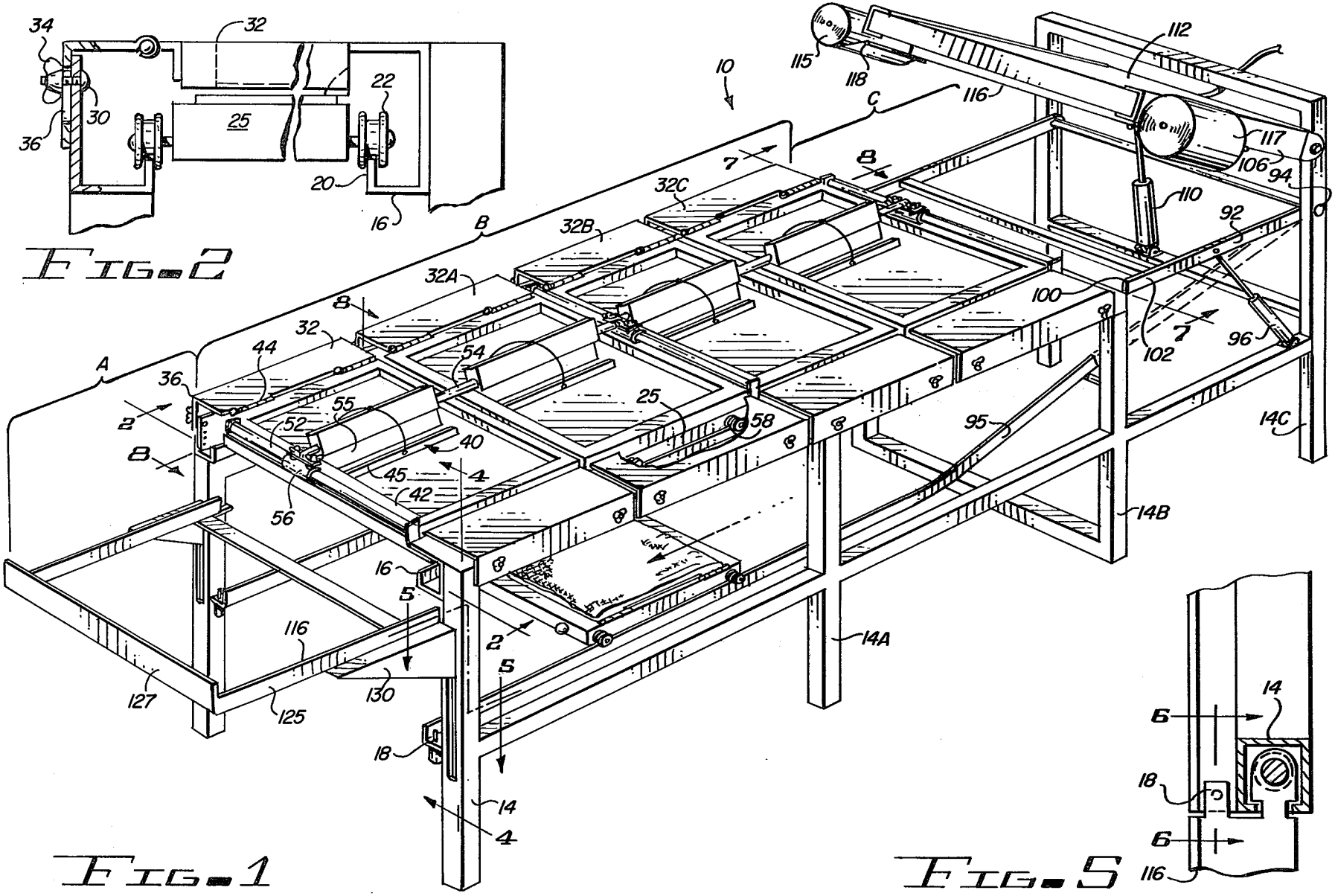
FIG. 1 is a perspective view of the screen printing apparatus of the present invention.
FIG. 2 is a sectional view taken along lines 2—2 of FIG. 1.
FIG. 5 is a sectional view taken along lines 5—5 of FIG. 1.
Figure 3:
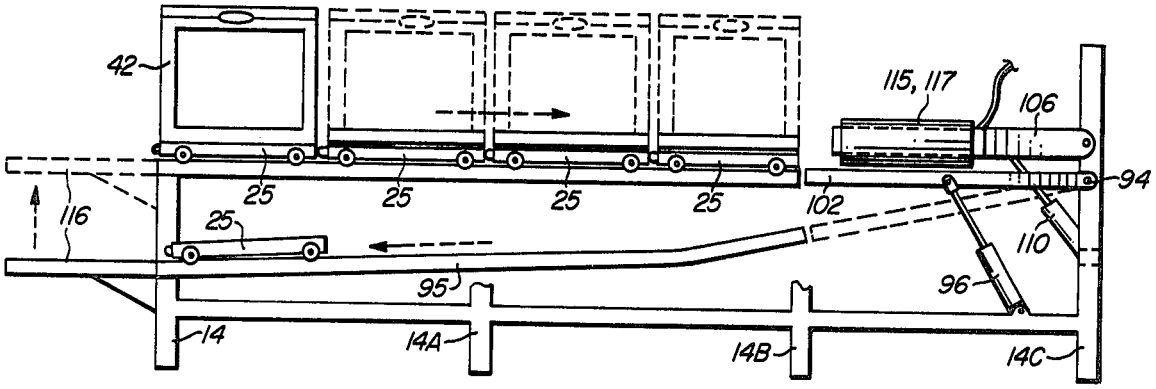
FIG. 3 is a side elevational view of the screen printing apparatus of the present invention.

Turning now to the drawings, the screen printing apparatus of the present invention is generally designated by the numeral 10 and generally comprised of three functional stations designated as loading (A), printing (B) and drying (C). The apparatus includes a longitudinally extending frame having spaced-apart vertical legs 14, 14A, 14B and 14C which support upper longitudinally extending track members 16 and subjacent lower longitudinally extending track members 18. As best seen in FIG. 2, the upper track members 16 are formed from generally C-shaped structural sections having vertically extending lip 20 which receives roller 22 for horizontally transporting carriage 25 as will be more fully explained hereafter. The vertical back section 28 of the channels 16 as viewed in FIG. 2 are provided with apertures 30 at pre-selected horizontally spaced-apart locations for adjustably mounting the printing heads 32, 32A, 32B and 32C, as will also be more fully explained hereafter.

As best seen in FIG. 1, the screen printing apparatus of the present invention is provided with a number of printing stations along section B, four being shown for convenience as four-color screen printing is conventional. It will be obvious that any desired number of stations can be provided. At each of the printing stations, a printing head 32 is secured to each of the track members 16, as viewed in FIG. 2, by a mechanical fastener shown as a wing nut 34 extending through section 28 and through L-bracket 36. Bracket 36 is provided with a vertical elongate slot 38 so that the vertical position of the printing head 32 can be selectively adjusted.

For convenience, the printing heads will be described with reference to head 32, it being understood that heads 32A, 32B, and 32C are similar in function and construction. Printing head 32 includes a frame 42 for receiving a printing screen 40 which screen is shown as being generally rectangular but which may be any shape. The frame section 42 may include an inner stretcher frame and an outer frame as is known in the screening art. Frame 42 is shown as being connected to L frame member 36 by appropriate hinges 44 which may be hinges of the continuous "piano" type but also may be rigidly secured to brack 36. A squeegee 45 is cooperable with each of the printing heads 32. The squeegee includes transverse guide bars 52 which support a longitudinal squeegee bar 54 at bearings 56. A squeegee blade 55 depends from the bar 54 at each of the printing stations. If desired, a squeegee blade 55 may be vertically adjusted relative to the printing head. Ink or dye is placed on the screen 40 and the squeegee blade 55 is moved transversely causing ink or dye to be forced through selected areas of the screen or mesh 40 transmitting a desired colored pattern to the subjacent workpiece.

Figure 7:
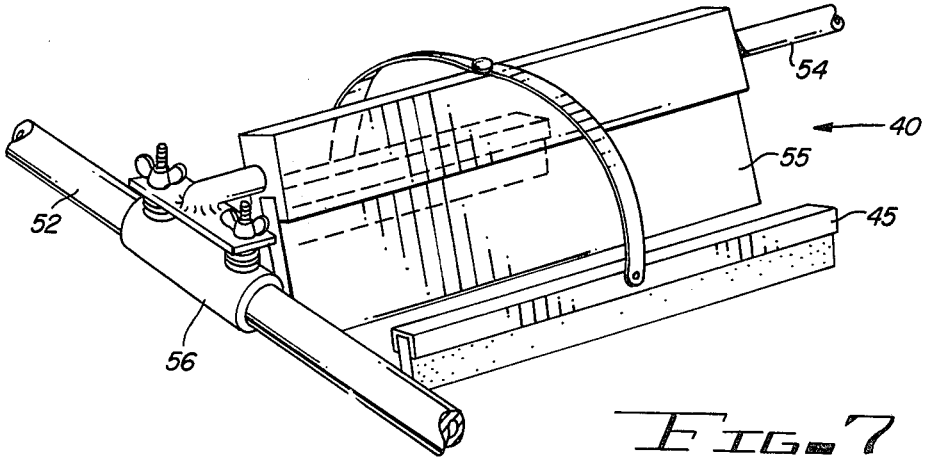
FIG. 7 is a perspective view of an alternate squeegee arrangement.
Figure 8:
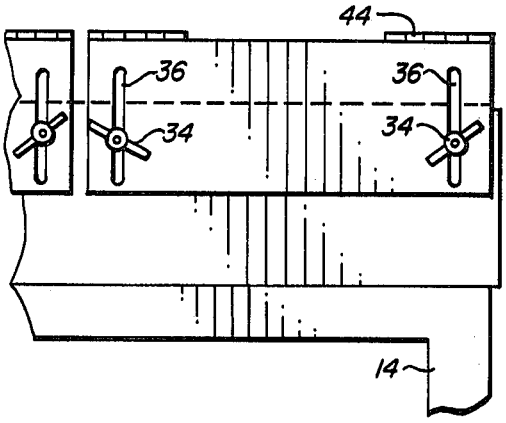
FIG. 8 is a sectional view taken along lines 8—8 of FIG. 1.

Automatic ink or dye feed systems may also be utilized if desired. FIG. 7 illustrates an alternate squeegee system 150 for automatic or auto flood ink or dye application. A conventional squeegee 55 is again mounted on longitudinal bar 54 which is transversely moveable at journal bearing 56 on bar 52. Springs 152 urge bar 54 upwardly and vertical adjustment of the squeegee is achieved at wing nuts 154. A squeegee 160 of softer material is suspended on bracket 156 at either side of main squeegee 55 to assist in spreading the ink or dye evenly.

Figure 9:
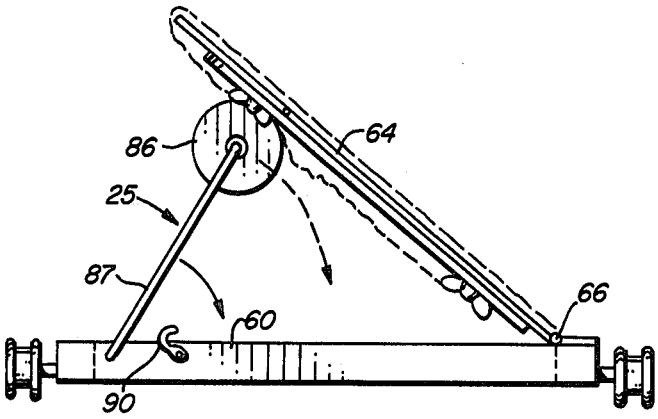
FIG. 9 is an end view of the carrier and platen with the platen in a raised position.
Figure 10:
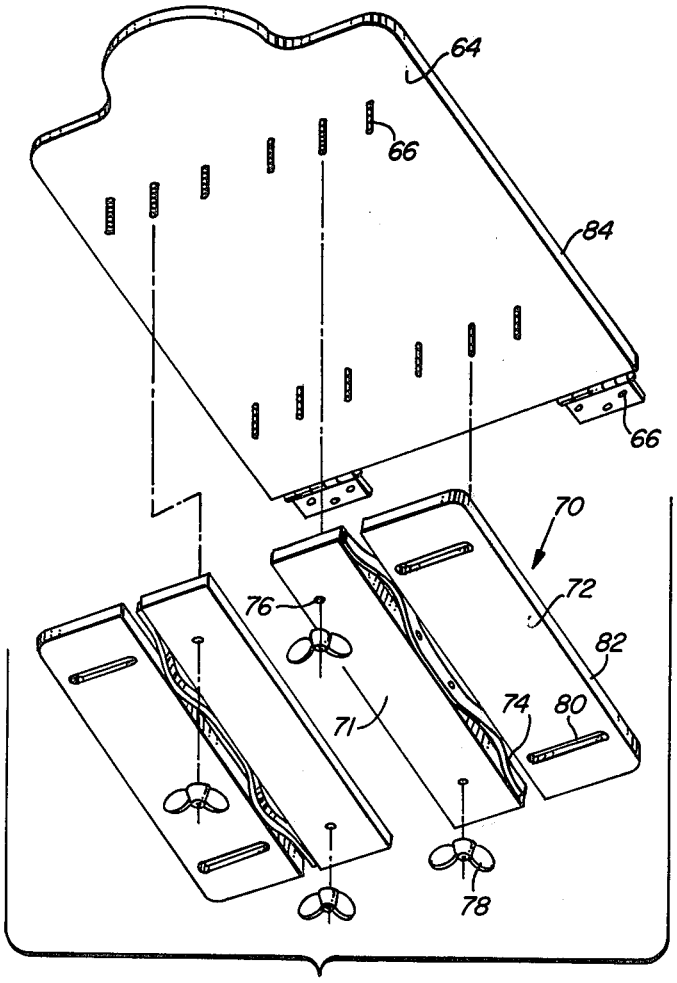
FIG. 10 is a bottom perspective view of the platen as shown in FIG. 9.
Figure 11:
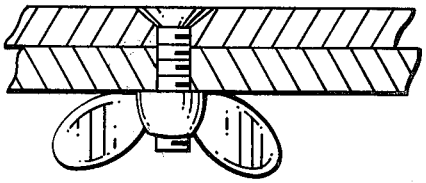
FIG. 11 is a partial sectional view of a portion of the platen.

The workpiece, such as a T-shirt, is advanced through the screen printer 10 on carriers 25 which include an adjustable platen or workpiece holder. The carrier is best seen in FIGS. 9 through 11 and includes a table or base member 60 shown as generally rectangular having a pair of rollers 22 rotatably supported at opposite longitudinal edges 62 of the table which are grooved at 61 and engage lip portion 20 of tracks 16. Bumper 65 in the form of wave springs, extends along opposite transverse sides of carrier 25 to absorb any shock imposed by bumping of adjacent carriers. Track 16 is provided with notches 58 at pre-selected longitudinal locations so the carriers can be brought into precise registry with the overlying printing head 32. Rollers 22 will engage the selected notches in the track enabling the operator to determine when proper registry has been achieved. A detent mechanism having a spring biased detent pin engageable with an aperture in the carrier may also be used to obtain proper alignment and registry with the printing heads. Similarly, tracks 16 can be configured as a gear rack and rollers 22 provided with gear teeth to achieve registry.

As best seen in FIGS. 9 and 10, carrier is provided with a platen 64 which is secured by hinge 66 to table 60. Platen 64 may be any suitable shape but is shown being generally rectangular adapted to accomodate an item of apparel such as a T-shirt and preferably is provided with a covering such as silicone rubber to provide some compressibility. When other shapes or other types of articles are used as the workpiece, the physical shape and geometry of the platen can be accordingly varied.

The platen of the present invention includes means for maintaining the workpiece in a taut position on the platen. As best seen in FIG. 10, the underside of the platen 64 is provided with two transverse rows of depending threaded studs 66. Tightening frame members 70 for holding a workpiece taut are shown as elongate panels 71 and 72 interconnected by a wave spring 74. Member 71 is provided with two spaced-apart apertures or holes 76 which can be secured to selected studs 66 by wing nuts 78. A pair of transverse slots 80 are provided in member 72 so that the longitudinal edge 82 of member 72 can be selectively positioned with respect to edge 84 of the platen 64. Thus when a workpiece such as a T-shirt is pulled over the platen 64, edge 82 will exert a transverse spring force to maintain the shirt in a taut position on the platen.

In addition to tightening frame members 70, roller 86 is secured to the tray 60. Roller 86 is pivotally mounted on arm 87 and is foldable downwardly as indicated by the arrow in FIG. 9. When the workpiece is pulled over the platen 64 and the platen pivoted to its downward position and locked in a horizontal position by means of latch 90, the rollers will engage the portion of the garment on the underside of the platen tending to pull the garment taut.

The screen printing apparatus of the present invention is shown having four printing stations in section B. At the end of the printing section B is a continuous drying section C having opposite track sections 92 which are pivotal about pivot point 94 from a generally horizontal position to position aligned with the inclined section 95 of the lower return track 18. Pivoting of track sections 92 from the horizontal position to the inclined position is controlled by means of a pneumatic or hydraulic actuator 96 mounted in a clevis arrangement extending between leg 14C and track 92. A locking mechanism engages the carrier 25 to hold the carrier in position as the track is rotated or pvioted from the horizontal to the inclined unloading position. The latch may simply be in the form of a simple detent 100 actuated by means of a small hydraulic or pneumatic cylinder 102.

Drying section C includes a frame member 106 which is pivotally secured to vertical leg 14C at pivot pin 108. Frame 106 is pivotal from the raised position shown in FIG. 1 to the drying position by means of a hydraulic or pneumatic actuator 110. In the drying position, frame 106 assumes a generally horizontal position bringing the heating surface 112 within the frame into engagement or close proximity with the platen 64 of the carrier 25. The heating and drying element may be ultra violet, infra red or hot air but preferably is a silicone rubber resistance heater which will resist the detrimental effects of the dyes and provide rapid drying of the workpiece. Several types of resistance elements can be used, either the wire-wound type in which fine resistant wires are spiraled around a fiberglass cord and vulcanized between thin layers of fiberglass reinforced silicone rubber or the etched foil type. The advantage of the heating element of this type is that the element can be selected to conform to any shape and even heating is achieved. The type of silicone rubber heater as manufactured by Watlow of St. Louis, Mo. have been found to be satisfactory. In some instances it may be necessary to interpose a transfer paper between the workpiece and the heater. To this end a transfer paper feed roller 180 and a take-up roller 182 are mounted on frame 106 so a silicone or teflon treated paper 184 can be positioned immediately below the heating surface 112. When a section of paper is no longer useable, a new section can be advanced into position.

With some processes intermediate drying between printing stations may be required. Accordingly, a heating element such as hot air, ultra violet or infra red may be required at selected locations in the printing section A. In FIG. 1, an infra red heat source 190 is shown mounted on leg 14A directed toward the underside of carriers 25 to assist in drying the workpiece.

Figure 4:
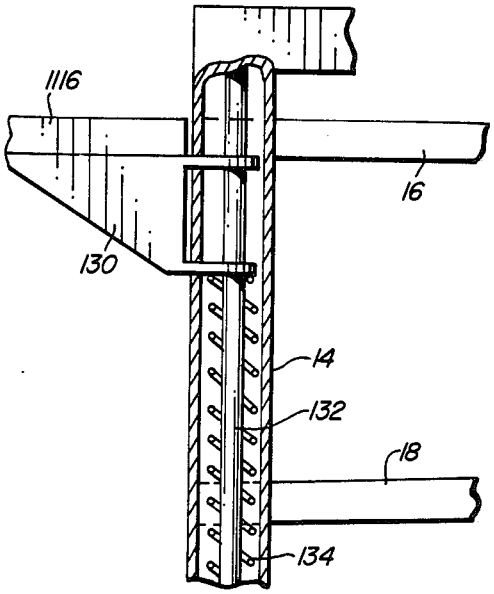
FIG. 4 is a sectional view taken along lines 4—4 of FIG. 1.
Figure 6:
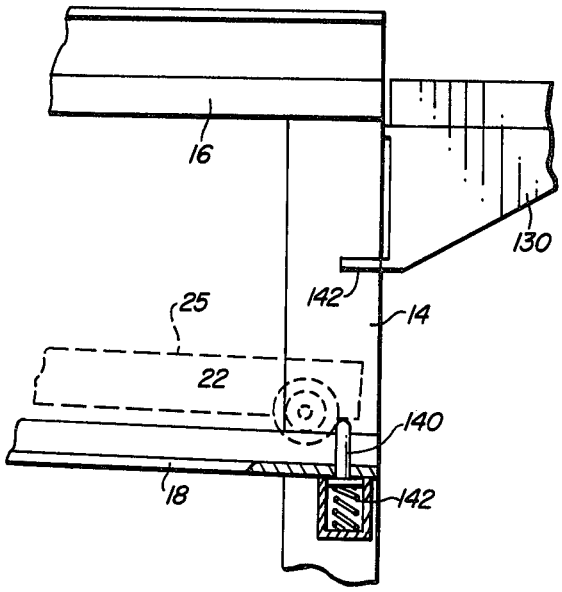
FIG. 6 is a sectional view taken along lines 6—6 of FIG. 5.

Return track 18 has an inclined section 95 which permits carrier 25 when released to travel under the influence of gravity to the loading and unloading section A at the front end of the machine. For convenience, the loading and unloading section C includes a vertically displaceable loading tray 125 having opposite longitudinally extending track members 116 and end plate 127. As best seen in FIGS. 4 and 6, the tray 125 is supported for vertical movement on brace members 130 which are vertically slideable along guide rods 132 within opposite vertical legs 14. Biasing spring 134 urges the tray to the upper position with tracks 116 in alignment with upper horizontal track 16. Spring biased detent pin 140 extends through the end of track section 18 adjacent vertical leg 14. As best seen in FIG. 6, detent pin 140 will engage the carrier 25 to prevent the carrier from being discharged from the end of track 18 until tray 125 is in a horizontal position and in alignment with lower track 18. Guide 130 carries stop tab 143 which serve to depress detent 140 against the action of spring 142 when tray 125 is moved to the lower position. Tray 125 can be actuated manually by the operator or can be actuated by means of a suitable hydraulic or pneumatic cylinder not shown. The hydraulic or pneumatic controls are well-known to those skilled in the art and detailed description has been omitted for clarity.

The method and apparatus of the present invention will be more fully understood from the following description of use. The screen printing apparatus 10 of the present invention is designed for high production rates for application of multiple colors to a workpiece as for example a T-shirt. The various printing heads 32 will be provided with the appropriate screen 40 mounted within frame 42 for application of the desired design to the workpiece. The height of the printing head 32 can be adjusted in accordance with the dictates of the process by positioning bracket 36 relative to section 36 and tightening wing nut 34. The appropriate color or dye is placed within printing heads 32.

The carriers 25 are positioned on the loading station 125 with the rollers 22 of the carrier engaging the opposite track members 116. Biasing spring 132 serves to hold the loading tray 125 in the upper position with the tracks 126 aligned with upper horizontal tracks 16. Platen 64 is raised to the inclined position shown in FIG. 9 and tightening plates 70 and 72 are appropriately positioned on the underside of platen 84 to exert transverse tightening force to draw the workpiece taut and flat across the upper surface of platen 64. Roller 86 also serves to facilitate loading of the workpiece on the platen and when the platen is pivoted downward into a generally horizontal position with respect to the tray 60, the roller serves further to pull the material taut. Latch 90 is engaged and the carriage 25 can be advanced horizontally to the first printing station. When the carriage is advanced to the first station and in registry with the first printing head 32, the rollers 22 will engage the notches 58 in the track 16 so the operator is assured of the proper registry. The appropriate ink or dye may then be put in the frame 42 of the first printing station. Printing of materials affected by relative movement between the squeegee blade 54 and the stenciled portion of the screen. This is accomplished by moving squeegee blade 54 transversely within the frame. The squeegee blade forces the printing ink or dye through the stenciled portion of the screen to print the material at the upper surface of the subjacent platen 64.

When this is complete, another carriage 25 can be placed in the loading tray 125 and advanced into the machine. This will place the initial carriage 25 in registry at the second printing station 32A and the second carriage will now be in registry at the first printing station 32, proper registry being maintained by the notches or on detent in the track 16. Ink may now be placed on the second screen 40A and the squeegee blade 55 advanced. This will cause the squeegee blades in the frames to be moved causing ink to be transferred to the subjacent workpiece at the first two printing heads. Additional carriers are loaded into the machine until the required number of colors have been applied to the workpiece. The initial carrier 25 reaches the drying station by advancing onto horizontal track section 92. Dryer unit 106 is actuated from the raised position into lower position in contact or close contact with the upper surface of the platen 64. Contact paper 184 is positioned between the heating surface and the workpiece. Pivotal motion is imparted to the heating unit by means of actuator 110 which when pressurized, extends to bring the silicone rubber element 112 into contact with the platen. The contact is maintained for the requisite time until the ink is dried and the cylinder 110 retracted to pivot the heating unit to the raised position. Thereafter, latch 100 engages carrier 25 and hydraulic actuator 96 retracts to pivot tracks 92 to the inclined discharge position which brings track 92 into alignment with inclined section 95 of the lower track 18. When the tracks are in alignment, latch 100 is released permitting carrier 25 to travel under the influence of gravity along track 115, track 18 and on to tray 125 which has been moved to the lower position to receive the carrier. In the event tray 125 has not been moved to the lower position, detent 140 will retain the carrier 25 at the end of track 18. Carrier 25 with the printed and dried workpiece will then be released to the upper position which allows the tray to return to a position in alignment with upper track 16. Latch 90 is released and platen 64 moved to a pivoted inclined position shown in FIG. 9 so the workpiece can be removed and a new workpiece inserted for processing.

Thus it will be seen that the present invention provides a unique multi-station screen printer for applying screen printing to a wide variety of materials. The printer of the present invention can be provided any number of stations to apply as many colors and designs as required. The screen printer of the present invention can be manually actuated or can be fully automated requiring a minimum of operator attention. The unique dryer facilitates high speed production of workpieces. The linear or in-line design of the machine is simple and compact and lends itself to installation in almost any location. As a manually operated machine, the arrangement of the machine allows the single operator working at the loading and unloading end to control the machine.

It will be obvious to those skilled in the art to make various changes, alterations and modifications to the embodiments herein described. To the extent that these changes, alterations and modifications do not depart from the spirit and scope of the appended claims, they are intended to be encompassed therein.

I claim:

1. A screen printer for applying a design to a workpiece using a printing medium comprising:

(a) a printing section having a frame including:
(i) a first horizontal track on said frame and a second spaced-apart return track disposed subjacent said first track and generally parallel thereto;
(ii) a plurality of printing heads disposed adjacent said first track defining printing stations, said printing heads having squeegee means associated therewith for applying a printing medium to the workpiece;
(b) a drying section contiguous and aligned with said printing section and including:
(i) a moveable receiving track having a first position in alignment with said first track of said printing section and moveable to a second position aligned with the said second track of said printing section;
(ii) heating means moveable from a first position to a second drying position adjacent the said receiving track in said first position; and
(c) carrier means moveable along said tracks, said carrier means including platen means associated therewith for receiving a workpiece whereby the workpiece may be placed on said platen means on said carrier means and advanced through said printing section for application of a printing medium at each of the said stations in said printing section to said drying section and thereafter transferred to said second track at said receiving track by moving said receiving track from said first position to said second position to be returned along said second track whereby the operator can remove the completed workpiece and replace the workpiece with a new workpiece.

2. The screen printer of claim 1 wherein said platen means is hingedly affixed to a base moveable along said track and wherein said platen incorporates spring biasing means for holding the workpiece in a taut position on said platen.

3. The screen printer of claim 1 further including an unloading and loading station moveable between said second track and first track for returning said carrier to a position aligned with said first track for unloading a workpiece and replacing the workpiece with a new workpiece.

4. The screen printer of claim 1 wherein said drying section includes a heating element of silicone rubber.

5. The screen printer of claim 4 wherein said drying section includes means for positioning a transfer medium between said heating means and said workpiece.

6. The screen printer of claim 1 further including a carrier loading tray at said printing section, said loading tray being displaceable between a first position aligned with said first track and a second position aligned with said second track and including detent means for retaining said carriers on said second track when said loading tray is in said first position.

* * * * *